US006071142A

United States Patent [19]

Blackman

[11] Patent Number: 6,071,142

[45] Date of Patent: Jun. 6, 2000

[54] DEVICE FOR PREVENTING PLUG REMOVAL FROM WALL OUTLET

[76] Inventor: Melvin Blackman, 106 Gates Ave., Brooklyn, N.Y. 11238

[21] Appl. No.: 09/130,849

[22] Filed: Aug. 7, 1998

[51] Int. Cl.[7] ..... H01R 13/62

[52] U.S. Cl. ..... 439/373

[58] Field of Search ..... 439/373, 371, 439/372, 41, 345, 42, 358, 369

[56] References Cited

U.S. PATENT DOCUMENTS

| | | | |
|---|---|---|---|
| 2,728,058 | 12/1955 | Phalen | 439/371 |
| 2,913,791 | 11/1959 | Martin | 24/126 |
| 3,049,688 | 8/1962 | Sinopoli | 439/41 |
| 4,037,901 | 7/1977 | Kaszuba | 339/41 |
| 4,424,407 | 1/1984 | Barbic | 174/67 |
| 4,457,571 | 7/1984 | Lavine et al. | 339/75 P |
| 4,531,800 | 7/1985 | Avener | 339/75 P |
| 5,348,495 | 9/1994 | Kasden | 439/371 |
| 5,549,482 | 8/1996 | Langlais | 439/369 |
| 5,655,924 | 8/1997 | Cross et al. | 439/373 |

*Primary Examiner*—Steven L. Stephan
*Assistant Examiner*—Eugene G. Byrd
*Attorney, Agent, or Firm*—Goldstein & Canino

[57] ABSTRACT

A power cord removal prevention device, for use with a power cord plug in preventing inadvertent removal of the power cord plug from an outlet that is mounted in a wall. The device has a bridge having a clamp which selectively creates an opening which can secure the power cord therein. A pair of suction cups are attached to the bridge by perpendicular members. The suction cups attach to the wall and divert any tension in the power cord away from the plug and toward the wall.

6 Claims, 2 Drawing Sheets

DEVICE FOR PREVENTING PLUG REMOVAL FROM WALL OUTLET

BACKGROUND OF THE INVENTION

The invention relates to a device for preventing plug removal from a wall outlet. More particularly, the invention relates to a device which attaches to the plug end of a power cord, and secures to the wall surrounding the outlet wherein the plug is attached, to prevent the plug from being inadvertently pulled from said outlet.

A standard plug designed for use with AC outlets within the United States employs two or three plate-like prongs which extend directly into slots in the outlet. Often the slots in the outlets contain spring clips to provide some resistance to both insertion and withdrawal of the prongs. Thus, the spring clips serve to help maintain the prongs in the outlet, and mostly prevent the weight of the power cord itself from pulling the prongs out of the outlet. However, the strength of the clips do not provide sufficient resistance to prevent the prongs from pulling out of the outlet when the cord is placed under any significant tension.

Vacuum cleaners are usually the worst culprit. The user often tests the limit of the power cord to see just how far the vacuum cleaner will reach before the power cord must be relocated to another outlet. Power tools are another frequent offender. When working, the tool user often tries to see just how far the tool will reach without using an extension cord. In general, whenever the cord is plugged into another room so that the plug is out of sight to the user, the user will pull and pull until the plug is pulled out of the outlet.

When a standard power cord is pulled with even slight tension, it will usually pull free of the outlet. Unfortunately, when the plug breaks free of the outlet, it is not usually a clean break. In other words, if the pulling force comes from an angle other than perpendicular to the outlet, the prongs will usually bend as they exit the outlet slot. In addition, frequent pulls upon the cord will often weaken and eventually break the connections between the power cord and the plug itself.

In recent years devices have been developed which attempt to prevent disconnection at an extension cord junction. In order to prevent disconnection at such a junction, workmen will often tie both extension cords into an "overhead" knot to prevent the plugs from detaching. Other devices have been proposed which seek to lock the extension cords together to prevent the wear and tear associated with tying the cord into a knot. In any case, these devices and methods are suitable for preventing extension cords from detaching from each other, but are not suitable for use with preventing a single power cord plug from inadvertently pulling out of a wall outlet.

While these units may be suitable for the particular purpose employed, or for general use, they would not be as suitable for the purposes of the present invention as disclosed hereafter.

SUMMARY OF THE INVENTION

It is an object of the invention to produce a plug removal preventing device which effectively prevents an electrical plug from being pulled from a wall outlet. Accordingly, the device attaches directly to the power cord and secures to the wall, thereby preventing any tension upon the cord from being communicated to the plug.

It is another object of the invention to produce a plug removal preventing device which can withstand a casual or even a strong pull upon the power cord and still maintain the plug within the outlet. Accordingly a pair of suction cups are provided which strongly adhere to the wall just adjacent to the outlet.

It is a further object of the invention to provide a plug removal preventing device which easily attaches onto a power cord just adjacent to its plug. Accordingly, the device comprises a bridge which both connects the suction cups and has a central clamp which crimps upon the power cord to securely attach thereto.

The invention is a power cord removal prevention device, for use with a power cord plug in preventing inadvertent removal of said plug from an outlet that is mounted in a wall. The device has a bridge having a clamp which selectively creates an opening which can secure the power cord therein. A pair of suction cups are attached to the bridge by perpendicular members. The suction cups attach to the wall and divert any tension in the power cord away from the plug and toward the wall.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
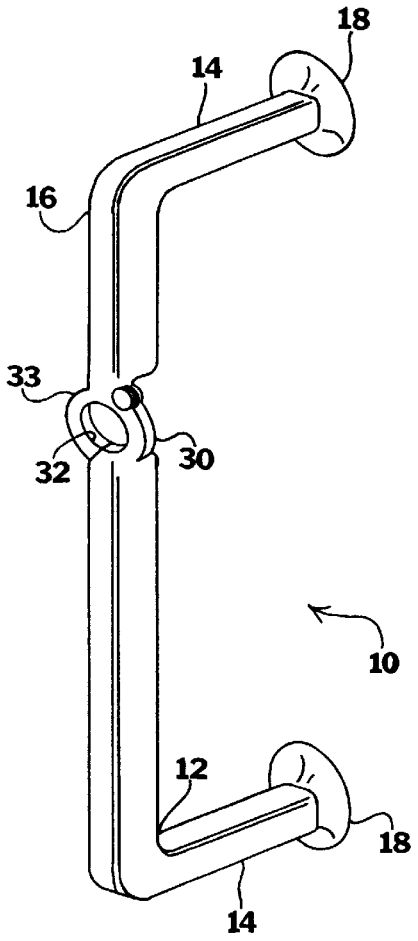
FIG. 1 is a diagrammatic perspective view, illustrating the invention, per se.

FIG. 1 illustrates a plug removal preventing device 10, comprising a main body 12 including a pair of perpendicular members 14 and a bridge 16 extending between the perpendicular members 14. The perpendicular members 14 extend parallel to each other. A pair of suction cups 18 are located on the perpendicular members 14 fully opposite from the bridge 16.

The bridge 16 comprises a central clamp assembly 30 having an opening 32 which is selectively completely encircled by a clamp 33. The central clamp assembly 30 has a hinge 35 for allowing the clamp 33 to selectively open an close around the opening 32. The central clamp assembly 30 is located midway between the perpendicular members 14.

Figure 2:
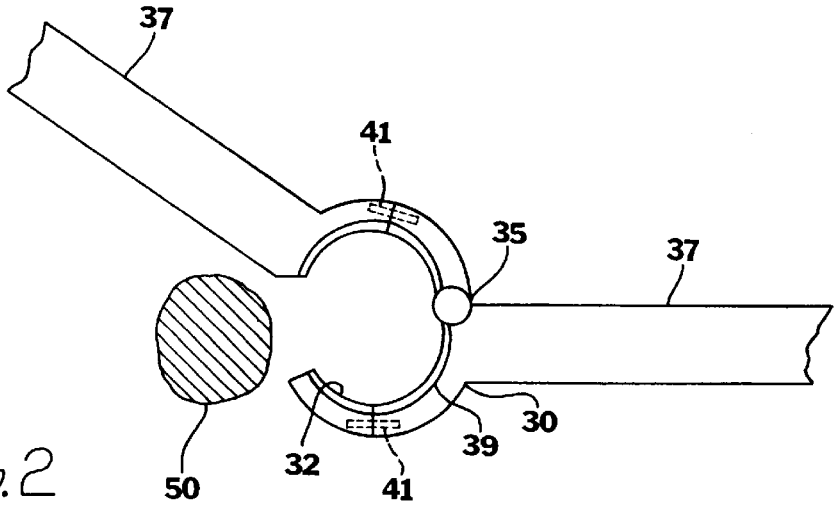
FIG. 2 is a front elevational view, illustrating the invention, wherein the central clamp is in its open position, and a power cord is about to be inserted therein.

FIG. 2 is a front elevational view, detailing the central clamp assembly 30. The clamp assembly 30 divides the bridge into two bridge halves 37. The bridge halves 37 are hingeably connected with the hinge 35. The hinge 35 allows the clamp 33 to selectively open and close to open and close the opening 32. A power cord 50 may be inserted into the opening 32 when the clamp 33 is open. The power cord 50 is held tightly within the opening 32 when the clamp 33 is closed. The opening 32 is lined with a rubber lining 39. The rubber lining 39 allows the clamp 33 to hold the cord 50 tightly without damaging said cord 50. The opening 32 may be adjusted in size with internal leaves 41 within the clamp assembly 30.

Figure 3:
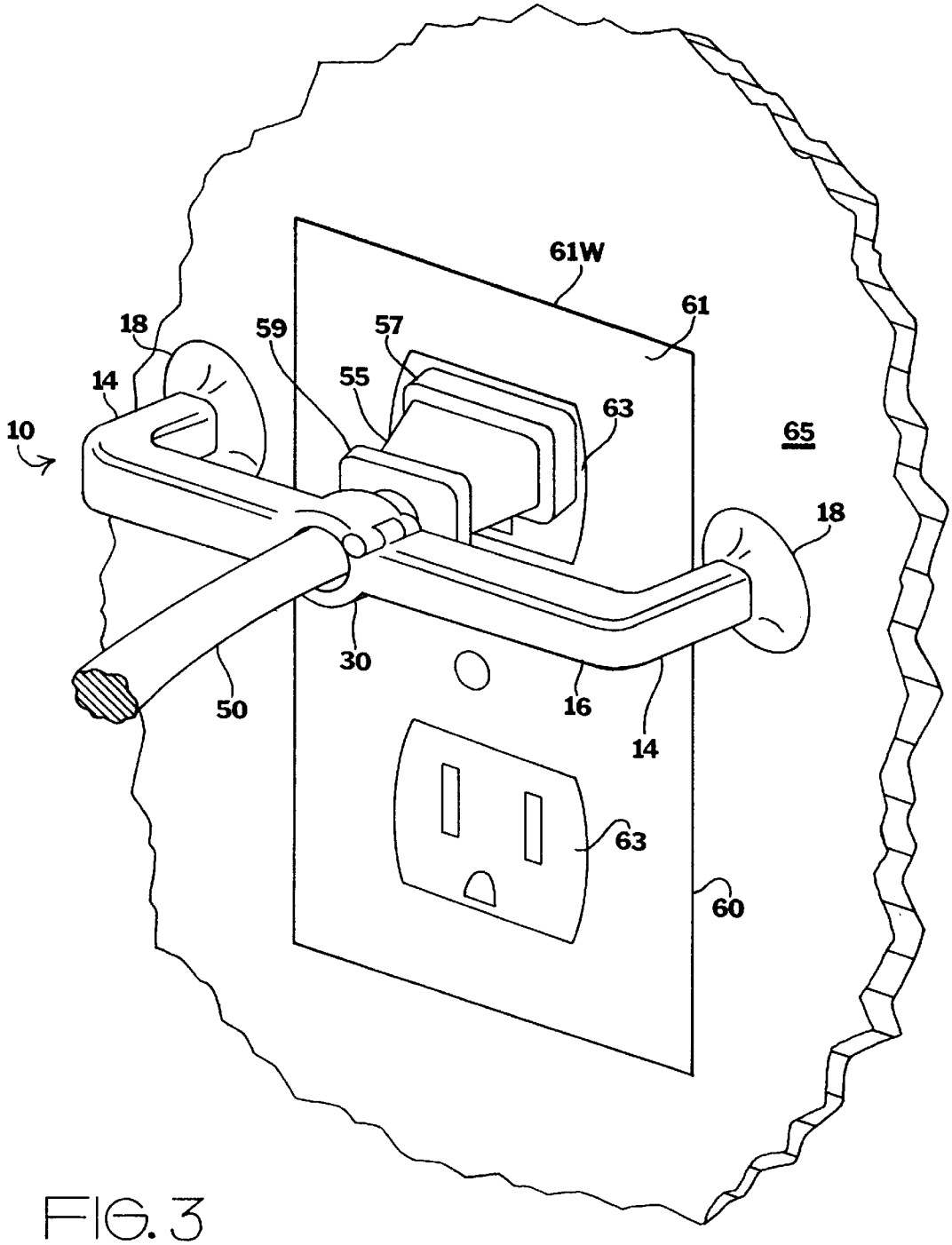
FIG. 3 is a diagrammatic perspective view, illustrating the invention in use, secured to a power cord, and secured onto the wall surrounding a power outlet.

FIG. 3 illustrates the plug removal prevention device 10 in use. An outlet box 60 comprises an outlet plate 61 having a plate width 61W. The outlet box 60 is mounted in a wall 65. The outlet plate 61 is relatively flat, and rests against the wall 65. The outlet box 60 comprises a pair of outlets 63. A plug 55 is connected to the power cord 50. the plug 55 has an inner flange 57 which rests against the outlet 63 when the plug 55 is fully within the outlet 50, and an outer flange 59 which directly adjoins the power cord 50.

The plug removal prevention device 10 is attached onto the power cord 50, wherein the central clamp assembly 30 is tightly grasping the power cord adjacent to the outer flange 59 of the plug 55. The plug 55 is connected within one of the outlets 63 of the outlet box 60. The suction cups 18 are fixed to the wall 65 beside the outlet plate 61. Thus, any tension upon the power cord 50 is translated by the bridge 16 and perpendicular members 14 through the suction cups 18 to the wall 65. No tension is exerted upon the plug, and no tendency exists to pull the plug 55 from the outlet 63. Thus, the bridge 16 must be long enough to ensure that the suction cups 18 can straddle the outlet plate 65. Since the outlet plates 65 for single outlets are standard in size, the bridge 16 can be appropriately sized. Similarly, the perpendicular members 14 should be of sufficient length to ensure that the bridge 16 clears the outer flange 59 of the plug 55. Thus the perpendicular members 14 should exceed in length the distance between the inner flange 57 and outer flange 59 of a standard plug 55.

In conclusion, herein is presented a device for preventing a power cord plug from being inadvertently pulled from a wall outlet. The device comprises a bridge which has a central clamp that secures to a power cord, and a pair of suction cups flanking the bridge which straddle the outlet and attach the wall adjacent thereto. Thus, the device translates any tension upon the power cord to the wall, and removes any tendency for the plug from being pulled from the power outlet.

What is claimed is:

1. A power cord plug removal prevention device, for use in preventing a power cord plug from being inadvertently pulled from an outlet located in a wall, comprising:

a bridge;

a clamp attached to the bridge, the clamp having an opening for securing around the power cord such that the plug can be inserted into the outlet; and a pair of suction cups attached to the bridge, the suction cups secure to the wall beside the outlet when the plug is in the outlet and rigidly connect the wall to the power cord with the clamp through the bridge to prevent tension on the plug from pulling the plug from the outlet.

2. The power cord plug removal prevention device as recited in claim 1, further comprising a pair of perpendicular members, the perpendicular members attached to the bridge and extending parallel to each other and perpendicular to the bridge, the suction cups each attached to one of the perpendicular members fully opposite the bridge.

3. The power cord plug removal prevention device as recited in claim 2, wherein the bridge further comprises a central clamp assembly located midway between the perpendicular members, the central clamp assembly having the clamp, the clamp hingeably attached to the bridge for selectively opening and closing to allow a power cord to be inserted therein and then secured therein.

4. The power cord plug removal prevention device as recited in claim 3, wherein the clamp assembly further comprises a rubber lining extending around the opening, for allowing the clamp to tightly hold the power cord while preventing damage thereto.

5. The power cord plug removal prevention device as recited in claim 4, the outlet having an outlet cover of standard width, wherein the bridge has a length which is sufficient to allow the suction cups to straddle the outlet.

6. The power cord plug removal prevention device as recited in claim 5, wherein the plug has an inner flange which rests against the outlet when the plug is fully inserted into the outlet and an outer flange just adjacent to the power cord, and wherein the perpendicular members have sufficient length so that the bridge clears the outer flange when the suction cups are fixed to the wall surrounding the outlet.

* * * * *